US011518958B2

(12) United States Patent
Tajmamet et al.

(10) Patent No.: US 11,518,958 B2
(45) **Date of Patent: *Dec. 6, 2022**

(54) CLEANING COMPOSITION

(71) Applicant: The Procter & Gamble Company, Cincinnati, OH (US)

(72) Inventors: Jamila Tajmamet, Brussels (BE); Greta Annie Renata Sanders, Boortmeerbeek (BE); Katrien Decraene, Ghent (BE)

(73) Assignee: Tire Procter & Gamble Company, Cincinnati, OH (US)

( * ) Notice: Subject to any disclaimer, the term of this patent is extended or adjusted under 35 U.S.C. 154(b) by 91 days.

This patent is subject to a terminal disclaimer.

(21) Appl. No.: 16/716,633

(22) Filed: Dec. 17, 2019

(65) Prior Publication Data

US 2020/0123468 A1 Apr. 23, 2020

Related U.S. Application Data

(63) Continuation of application No. PCT/US2018/040171, filed on Jun. 29, 2018.

(30) Foreign Application Priority Data

Jun. 29, 2017 (EP) ..... 17178824
Jan. 26, 2018 (EP) ..... 18153580

(51) Int. Cl.

| | |
|---|---|
| ***C11D 1/29*** | (2006.01) |
| ***C11D 1/75*** | (2006.01) |
| ***C11D 1/83*** | (2006.01) |
| ***C11D 3/22*** | (2006.01) |
| ***C11D 3/37*** | (2006.01) |
| ***B08B 3/04*** | (2006.01) |
| ***B08B 3/08*** | (2006.01) |
| ***C11D 1/831*** | (2006.01) |
| ***C11D 11/00*** | (2006.01) |
| ***C11D 17/00*** | (2006.01) |
| *C11D 1/66* | (2006.01) |

(52) U.S. Cl.

CPC ..... *C11D 1/831* (2013.01); *B08B 3/08* (2013.01); *C11D 3/3723* (2013.01); *C11D 11/0023* (2013.01); *C11D 17/0008* (2013.01); *C11D 1/29* (2013.01); *C11D 1/662* (2013.01); *C11D 1/75* (2013.01)

(58) Field of Classification Search

CPC ..... C11D 1/29; C11D 1/662; C11D 1/665; C11D 1/75; C11D 1/83; C11D 3/22; C11D 3/3723; B08B 3/04; B08B 3/08

See application file for complete search history.

(56) References Cited

U.S. PATENT DOCUMENTS

| | | | | |
|---|---|---|---|---|
| 6,509,306 | B1 | 1/2003 | Wisniewski | |
| 11,072,763 | B2 * | 7/2021 | Braeckman | C11D 3/0094 |
| 2004/0053804 | A1 | 3/2004 | Yomogida | |
| 2005/0049160 | A1 | 3/2005 | Szewczyk | |
| 2007/0275868 | A1 | 11/2007 | Cooremans | |
| 2009/0036345 | A1 | 2/2009 | Kulbick | |
| 2010/0197554 | A1 | 8/2010 | Koyuncu | |
| 2012/0225802 | A1 | 9/2012 | Perez-prat | |
| 2013/0303425 | A1 | 11/2013 | Scialla | |
| 2014/0206592 | A1 | 7/2014 | Keuleers | |
| 2020/0123469 | A1 | 4/2020 | Braeckman | |

FOREIGN PATENT DOCUMENTS

| | | | | |
|---|---|---|---|---|
| DE | 19534269 | A1 | 3/1997 | |
| DE | 19813042 | A1 | 9/1999 | |
| EP | 2216391 | A1 | 8/2010 | |
| EP | 2264138 | * | 12/2010 | C11D 17/00 |
| EP | 2264138 | B1 | 3/2013 | |
| EP | 2391699 | B1 | 6/2014 | |
| JP | 2000248293 | A | 9/2000 | |
| JP | 2002194388 | A | 7/2002 | |
| JP | 2005053971 | A | 3/2005 | |
| WO | WO9700930 | A1 | 1/1997 | |
| WO | WO9929815 | A1 | 6/1999 | |

OTHER PUBLICATIONS

U.S. Appl. No. 16/716,643, filed Dec. 17, 2019, Braeckman et al.
BASF: Glucopon 600 CSUP—XP055451381, Apr. 4, 2013. Retrieved from Internet: URL: https://biakhim.com.ua/index.php?option=com k2&Itemid=I174&id=I861fe38c5ffff002la365b97b4125b0331&lang=ru&task=download&view=item—Retrieved on Feb. 15, 2018.
Cognis: Glucopon 600 CS UP—XP055451377, Jan. 26, 2004. Retrieved from Internet: URL: http://www.bsibusiness.com/uploads/product/pdf/285 pdf.pdfRetrieved on Feb. 15, 2018.
European Search Report for International Application No./Patent No. 18153580.8-1106, dated Feb. 27, 2018, 8 pages.
Amphoteric Surfactants—XP55714793A, Retrieved from Internet: URL: https://www.chemicalbook.com/ProductCatatog_EN/1813.htm,Jul. 14, 2020, 2 pages.
Extended European Search Report and Search Opinion; Application Ser. No. 19186505.4-1106: dated Aug. 19, 2019; 10 pages.
Extended European Search Report and Search Opinion; Application Ser.No. 17178824.3-1358; dated Nov. 7, 2017: 10 pages.
International Search Report and Written Opinion; Application Ser. No. PCT/US2018/040171; dated Aug. 13, 2018, 13 pages.
All Office Actions; U.S. Patent Application U.S. Appl. No. 16/716,643.
Third Party Opposition filed for European Patent Application Ser. No. 18153580.8, dated Feb. 2, 2021, 7 pages.

* cited by examiner

*Primary Examiner* — Brian P Mruk
(74) *Attorney, Agent, or Firm* — Carolyn S. Powell; Carrie Schwartz

(57) ABSTRACT

The present invention relates to a hand dishwashing cleaning composition. In particular, the composition includes a surfactant system having an alkyl polyglucoside surfactant. The alkyl polyglucoside surfactant component allows for good dissolution profile of the composition during both manual dishwashing conditions with detergents dosed into a full sink or detergents directly dosed onto a sponge and washed under the tap. Process for preparing the composition and methods of use are also disclosed.

20 Claims, No Drawings

CLEANING COMPOSITION

FIELD OF THE INVENTION

The present invention relates to a cleaning composition. In particular, it relates to a hand dishwashing cleaning composition comprising a surfactant system including an alkyl polyglucoside surfactant for delivering a good dissolution and sudsing profile under different consumer washing habits.

BACKGROUND OF THE INVENTION

Traditionally, manual/hand dishwashing is performed in a sink full of water with the cleaning composition diluted in it. A user uses the appearance of foam as an indicator that the wash solution contains sufficient active detergent ingredients. Thus, these users desire fast dissolution of the cleaning composition with water to enable rapid formation of the foam. Later, when consumers visually notice undissolved detergent product on the bottom of the sink, it automatically triggers a reaction to start manually rubbing and agitating this undissolved product in order to facilitate dissolution, as such requiring an additional action step from the consumer hence driving consumer dissatisfaction. Indeed, consumers perceive this undissolved product as not contributing to the wash process and hence consider it as spent product without returning value to them.

An alternative type of washing method is usually performed under running water with product dosed directly on a cleaning implement (e.g., sponge, cloth). Here, users rely on the persistence of foam throughout the wash process as an indicator that the remaining cleaning composition in the cleaning implement still contains sufficient active ingredients. Accordingly, these users prefer a more gradual dissolution of the cleaning composition with water in the cleaning implement for gradual release of the product from the cleaning implement, thereby avoiding the need for frequent re-dosing of the cleaning composition.

The opposing tensions on desired dissolution profile makes it difficult to formulate a product that can satisfy both types of consumer habits. Thus, the need remains for a cleaning composition that possesses a good dissolution profile suitable for use with different types of hand dishwashing habits. The need also exists for a cleaning composition that provides good cleaning, in particular cleaning of soils and/or grease removal. It is desirable that the composition has a favourable suds profile across different types of hand dishwashing habits and wash conditions. The Applicant has discovered that some or all of the above-mentioned needs can be at least partially fulfilled through cleaning compositions as described herein below.

SUMMARY OF THE INVENTION

In one aspect, the present invention is directed to a hand dishwashing cleaning composition comprising: a) from 1% to 60%, preferably from 5% to 50%, more preferably from 8% to 45%, most preferably from 15% to 40%, by weight of the total composition of a surfactant system, and b) from 50% to 85%, preferably from 50% to 75%, by weight of the total composition of water. The surfactant system comprises: (i) from 60% to 90%, preferably from 65% to 85%, more preferably from 70% to 80%, by weight of the surfactant system of an anionic surfactant or mixtures thereof; (ii) from 10% to 40%, preferably from 15% to 35%, more preferably from 18% to 26%, by weight of the surfactant system of an amine oxide surfactant, a betaine surfactant or mixtures thereof, preferably an amine oxide surfactant; and (iii) from 0.5% to 20%, preferably from 0.75% to 15%, more preferably from 1% to 10%, most preferably from 1% to 5% by weight of the surfactant system of an alkyl polyglucoside surfactant or mixtures thereof. The alkyl polyglucoside surfactant contributes to a good dissolution and sudsing profile, e.g. a robust suds performance has been observed across a wide range of wash conditions including across a wide wash solution pH range. It also facilitates grease cleaning and contributes to the stability of the detergent. Furthermore, it has shown to help controlling viscosity neat and upon dilution in the wash water, at reduced use of organic solvents.

In another aspect, the present invention relates to a method of manually washing dishware comprising the steps of:

a) delivering a composition of the present invention onto soiled dishware or a cleaning implement, preferably a cleaning implement, more preferably a sponge;
b) cleaning the dishware with the composition in the presence of water; and
c) optionally, rinsing the dishware.

In another aspect, the present invention relates to a method of manually washing dishware comprising the steps of delivering a composition according to the invention into a volume of water to form a wash solution and immersing the dishware in the solution.

In another aspect, the present invention relates to the use of a composition of the invention for delaying dissolution of the composition with water in a cleaning implement, preferably a sponge, characterized by the composition having a decrease in viscosity of less than 85%, preferably less than 80%, more preferably less than 75%, most preferably between 65% and 75%, based on the initial viscosity of the composition at 60% product concentration in demineralized water at 20° C.

One aim of the present invention is to provide a hand dishwashing cleaning composition of the present invention which can exhibit good dissolution profile and sudsing profile, in particular fast dissolution under full sink washing condition and delayed dissolution under direct application of product on a cleaning implement and washing under tap.

Another aim of the present invention is to provide such a hand dishwashing cleaning composition of the present invention having a good sudsing profile, in particular fast suds volume build up and/or long lasting suds, preferably over the entire dishwashing process.

Another aim of the present invention is to provide such a hand dishwashing cleaning composition of the present invention having good cleaning, in particular good cleaning of light and/or tough soils, and/or grease removal.

Another aim of the present invention is to provide such a hand dishwashing cleaning composition of the present invention that is stable upon storage and shipping, even under stressed conditions.

Another aim of the present invention is to provide such a hand dishwashing cleaning composition of the present invention that controls the viscosity of the product neat as well as upon dilution through the wash process, at reduced use of organic solvents.

These and other features, aspects and advantages of the present invention will become evident to those skilled in the art from the detailed description which follows.

DETAILED DESCRIPTION OF THE INVENTION

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of" and "consisting essentially of." The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (e.g., polyethylene, polypropylene, polystyrene, etc.) and wood.

The term "dissolution profile" as used herein refers to the release with time into a washing solution of the detergent ingredients, particularly relevant for a full sink washing condition. The term "dissolution profile" may also refer to the release with time into water inside a cleaning implement of the detergent ingredients, particularly relevant for a direct application washing condition.

The term "dissolution time" when used herein relates to full sink washing conditions and means the time at which 70% of a composition has dissolved in water at 20° C. The determination is performed according to the test method described herein.

The term "grease" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The term "sudsing profile" as used herein refers to the properties of a cleaning composition relating to suds character during the dishwashing process. For example, the sudsing profile of a cleaning composition includes but is not limited to the suds volume generated upon dissolving and agitation, typically manual agitation, of the cleaning composition in the aqueous washing solution, and the retention of the suds during the dishwashing process. Preferably, hand dishwashing cleaning compositions require high sudsing and sustained suds. This is important as the consumer uses high sudsing as an indicator of the performance of the cleaning composition. Moreover, the consumer also uses the sustained suds as an indicator that the wash solution still contains active cleaning ingredients, even towards the end of the dishwashing process. The consumer usually renews the washing solution when the sudsing subsides. Thus, a low sudsing cleaning composition will tend to be replaced by the consumer more frequently than is necessary because of the low sudsing level.

It is understood that the test methods that are disclosed in the Test Methods Section of the present application must be used to determine the respective values of the parameters of Applicants' inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Composition

The Applicants have surprisingly discovered a new way of formulating cleaning compositions to provide good dissolution and sudsing profile, including high suds volume and/or suds stabilization benefit. The cleaning composition of the invention is especially suitable for use as a hand dishwashing detergent. Due to its desirable dissolution profile, it is extremely suitable for use in its neat form applied directly on a cleaning implement or in diluted form in a full sink of water to wash dishes.

The Applicants have also surprisingly discovered that when formulating with an alkyl polyglucoside surfactant, less solvent is required to meet the viscosity target needed to deliver the desired dissolution profile. Less solvent delivers the benefits of a more environmentally friendly and cost-efficient product. Beyond those benefits, the alkyl polyglucoside surfactant also functions as a cleaning aid and contributes to improved cleaning performance Without wishing to be bound by theory, it is believed that contrary to solvent the alkyl polyglucoside surfactant does not lead to strong thinning upon dilution. As a result, the product formulated with alkyl polyglucoside surfactant will not run quickly outside the cleaning implement (e.g., sponge) upon direct application usage and contact with water, and as such delays the need for frequent re-dosing of the product. Additionally, while the product takes longer to dissolve upon direct application, the Applicants have surprisingly discovered that the product dissolution in full sink washing condition is not compromised, thereby meeting demands for good dissolution and sudsing profile for both types of consumers with the same product formulation.

Other advantages associated with the composition of the present invention include that the composition presents good stability due to the compatibility of the surfactant system with the remaining ingredients of the composition. The composition can also be aesthetically pleasant because the presence of the surfactant system does not alter the appearance of the composition, i.e., transparent, translucent, etc. The composition of the present invention can also provide good grease removal, in particular good uncooked grease removal, The cleaning composition is preferably a hand dishwashing cleaning composition, preferably in liquid form. Preferably, the cleaning composition displays a delayed dissolution with water in a cleaning implement, preferably a sponge, characterized by the composition having a decrease in viscosity of less than 85%, preferably less than 80%, more preferably less than 75%, most preferably between 60% and 75%, based on an initial viscosity of the composition, at 60% product concentration in demineralized water at 20° C. Without wishing to be bound by theory it is believed that the retained "higher" viscosity throughout dilution reduces the "diluted" product flowability hence slows down the speed of product run out of the sponge.

The cleaning composition preferably exhibits a dissolution time of less than 160 seconds, preferably less than 155 seconds, measured as the dissolution time for 70% dissolution in water at 20° C. following the method described herein. Without wishing to be bound by theory, it is believed that products having a higher dissolution time will either: 1) trigger an additional manual agitation step with the consumer, or 2) demonstrate a too slow release of product actives, compromising the consumer's desire for a product having fast suds build up accordingly when used under full sink conditions.

The composition contains from 50% to 85%, preferably from 50% to 75% by weight of the total composition of a liquid carrier in which the other essential and optional components are dissolved, dispersed or suspended. One preferred component of the liquid carrier is water.

The pH of the composition is from about 6 to about 14, preferably from about 7 to about 12, or more preferably from about 7.5 to about 10, as measured at 20° C. and 10% aqueous concentration in distilled water. The pH of the composition can be adjusted using pH modifying ingredients known in the art.

The composition of the present invention can be Newtonian or non-Newtonian, preferably Newtonian. The composition has an initial viscosity of from 10 mPa·s to 10,000 mPa·s, preferably from 100 mPa·s to 5,000 mPa·s, more preferably from 300 mPa·s to 2,000 mPa·s, or most preferably from 500 mPa·s to 1,500 mPa·s, alternatively combinations thereof. Viscosity is measured with a Brookfield DV-II+ Pro viscometer using spindle 31 at 12 RPM at 20° C.

Surfactant System

The cleaning composition comprises from about 1% to about 60%, preferably from about 5% to about 50%, more preferably from about 8% to about 45%, most preferably from about 15% to about 40%, by weight of the total composition of a surfactant system.

The surfactant system of the composition of the present invention comprises an anionic surfactant. Preferably, the surfactant system for the cleaning composition of the present invention comprises from about 60% to about 90%, preferably from about 65% to 85%, more preferably from about 70% to about 80%, by weight of the surfactant system of an anionic surfactant or mixtures thereof. The anionic surfactant can be any anionic cleaning surfactant, preferably selected from sulphate and/or sulfonate and/or sulfosuccinate anionic surfactants. Especially preferred anionic surfactant is selected from the group consisting of alkyl sulfate, alkyl alkoxy sulfate and mixtures thereof, and preferably wherein the alkyl alkoxy sulfate is an alkyl ethoxy sulfate. Preferred anionic surfactant is an alkyl ethoxy sulfate with a mol average ethoxylation degree of less than 5, preferably less than 3, more preferably less than 2 and more than 0.5. Preferably the alkyl ethoxy sulfate anionic surfactant has a weight average level of branching of from about 5% to about 60%, preferably from about 10% to about 55%, more preferably from about 15% to about 50%, even more preferably from 20% to 45%, most preferably from 25% to 45%. This level of branching also contributes to better dissolution and suds lasting. It also contributes to the stability of the detergent at low temperature. Preferably the alkyl ethoxy sulfate anionic surfactant has a mol average alkyl carbon chain length between 10 and 14, preferably between 12 and 14. Most preferably, the alkyl ethoxy sulfate anionic surfactant has a mol average alkyl carbon chain length between 12 and 14, a mol average degree of ethoxylation of less than 2 and more than 0.5 and a weight average level of branching between 25% and 45%. Detergents having this ratio present good dissolution and suds performance.

When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the weight of sulfate anionic surfactant components not having alkoxylate groups should also be included.

$$\text{Mol average alkoxylation degree}=(x1*\text{alkoxylation degree of surfactant } 1+x2*\text{alkoxylation degree of surfactant } 2+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

If the surfactant is branched, the preferred branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the composition of the invention.

The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol } 1+x2*\text{wt \% branched alcohol 2 in alcohol } 2+\ldots)/(x1+x2+\ldots)]*100$$

wherein x1, x2, are the weight in grams of each alcohol in the total alcohol mixture of the alcohols which were used as starting material for the anionic surfactant for the detergent of the invention. In the weight average branching degree calculation, the weight of anionic surfactant components not having branched groups should also be included.

Suitable counterions include alkali metal cation earth alkali metal cation, alkanolammonium or ammonium or substituted ammonium, but preferably sodium.

Suitable examples of commercially available sulfates include, those based on Neodol alcohols ex the Shell company, Lial—Isalchem and Safol® ex the Sasol company, natural alcohols ex The Procter & Gamble Chemicals company. Suitable sulfonate surfactants for use herein include water-soluble salts of C8-C18 alkyl or hydroxyalkyl sulfonates; C11-C18 alkyl benzene sulfonates (LAS), modified alkylbenzene sulfonate (MLAS); methyl ester sulfonate (MES); and alpha-olefin sulfonate (AOS). Those also include the paraffin sulfonates may be monosulfonates and/or disulfonates, obtained by sulfonating paraffins of 10 to 20 carbon atoms. The sulfonate surfactants also include the alkyl glyceryl sulfonate surfactants.

The surfactant system of the composition of the present invention may further comprise an amine oxide surfactant, a betaine surfactant or mixtures thereof, preferably an amine oxide. Preferably, the surfactant system for the cleaning composition of the present invention comprises from about 10% to about 40%, preferably from about 15% to about 35%, more preferably from about 18% to about 26%, by weight of the surfactant system of an amine oxide surfactant, a betaine surfactant or mixtures thereof, preferably an amine oxide. Preferably, the amine oxide surfactant is selected from the group consisting of linear or branched alkyl amine oxide, linear or branched alkyl amidopropyl amine oxide, and mixtures thereof. More preferably, the amine oxide surfactant is linear C10 alkyl dimethyl amine oxide, linear C12-C14 alkyl dimethyl amine oxides and mixtures thereof. More preferably, the amine oxide surfactant is C12-C14 alkyl dimethyl amine oxide.

Preferably, the amine oxide surfactant is alkyl dimethyl amine oxide or alkyl amido propyl dimethyl amine oxide, preferably alkyl dimethyl amine oxide and especially coco dimethyl amino oxide, most preferably C12-C14 alkyl dimethyl amine oxide. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the α carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein. The amine oxide further comprises two moieties, independently selected from a C1-3 alkyl, a C1-3 hydroxyalkyl group, or a polyethylene oxide group containing an average of from about 1 to about 3 ethylene oxide groups. Preferably, the two moieties are selected from a C1-3 alkyl, more preferably both are selected as a C1 alkyl.

Alternatively, the amine oxide surfactant is a mixture of amine oxides comprising a low-cut amine oxide and a mid-cut amine oxide. The amine oxide of the composition of the invention then comprises:

a) from about 10% to about 45% by weight of the amine oxide of low-cut amine oxide of formula R1R2R3AO wherein R1 and R2 are independently selected from hydrogen, C1-C4 alkyls or mixtures thereof, and R3 is selected from C10 alkyls or mixtures thereof; and b) from 55% to 90% by weight of the amine oxide of mid-cut amine oxide of formula R4R5R6AO wherein R4 and R5 are independently selected from hydrogen, C1-C4 alkyls or mixtures thereof, and R6 is selected from C12-C16 alkyls or mixtures thereof In a preferred low-cut amine oxide for use herein R3 is n-decyl. In another preferred low-cut amine oxide for use herein R1 and R2 are both methyl. In an especially preferred low-cut amine oxide for use herein R1 and R2 are both methyl and R3 is n-decyl.

Preferably, the amine oxide comprises less than about 5%, more preferably less than 3%, by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Compositions comprising R7R8R9AO tend to be unstable and do not provide very suds mileage.

Suitable betaine surfactant includes alkyl betaines, alkylamidobetaine, amidazoliniumbetaine, sulfobetaine (INCI Sultaines) as well as the Phosphobetaine and preferably meets Formula (I):

$$R^1—[CO—X(CH_2)_n]_x—N^+(R^2)(R_3)—(CH_2)_m—[CH(OH)—CH_2]_y—Y— \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the Formula (Ia), the alkyl amido propyl betaine of the Formula (Ib), the Sulfo betaines of the Formula (Ic) and the Amido sulfobetaine of the Formula (Id):

$$R^1—N(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which R1 has the same meaning as in Formula (I). Particularly preferred betaines are the Carbobetaine [wherein Y—═COO—], in particular the Carbobetaine of the Formulae (Ia) and (Ib), more preferred are the Alkylamidobetaine of the Formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, cocoamidopropyl-betaine.

Preferably, the surfactant system of the composition of the present invention comprises an anionic surfactant and an amine oxide surfactant, wherein the ratio of the anionic surfactant to the amine oxide surfactant is from about 1:1 to about 8:1, preferably from about 3:1 to about 6:1, more preferably from 3.8:1 to 5.7:1. Detergents having this ratio present good dissolution and suds performance, both when used under full sink as well as under direct application on a cleaning implement consumer wash habits.

The surfactant system of the composition of the present invention further comprises from 0.5% to 20%, preferably from 0.75% to 15%, more preferably from 1% to 10%, most preferably from 1% to 5% by weight of the surfactant system of alkyl polyglucoside ("APG") surfactant. Preferably, the alkyl polyglucoside surfactant is a dominant C8-C16, preferably a dominant C8-C14 alkyl polyglucoside surfactant, more preferably a dominant C10-C14 alkyl polyglucoside, most preferably a dominant C12-C14 alkyl polyglucoside, preferably with an average degree of polymerization of between 0.1 and 3, more preferably between 0.5 and 2.5, even more preferably between 1 and 2, most preferably between 1.2 and 1.6. By "dominant" it means that the carbon chain length range present for the alkyl polyglucoside surfactant is at least 50%, preferably at least 60% by weight of the total alkyl polyglucoside surfactant content. Most preferably the alkyl polyglucoside surfactant has an average alkyl carbon chain length between 10 and 16, preferably between 10 and 14, most preferably between 12 and 14, with an average degree of polymerization of between 0.5 and 2.5 preferably between 1 and 2, most preferably between 1.2 and 1.6. C8-C16 alkyl polyglucosides are commercially available from several suppliers (e.g., Simusol® surfactants from Seppic Corporation; and Glucopon® 600 CSUP, Glucopon® 650 EC, Glucopon® 600 CSUP/MB, and Glucopon® 650 EC/MB, from BASF Corporation).

Preferably, the surfactant system of the composition of the present invention comprises: (i) from about 70% to about 80% by weight of the surfactant system of an alkyl ethoxy sulfate; (ii) from about 18% to about 26% by weight of the surfactant system of an amine oxide surfactant; and (iii) from about 1% to about 5% by weight of the surfactant system of an alkyl polyglucoside surfactant.

Preferably, the surfactant system of the composition of the present invention further comprises from about 1% to about 25%, preferably from about 1.25% to about 20%, more preferably from about 1.5% to about 15%, most preferably from about 1.5% to about 5% by weight of the surfactant system, of a non-ionic surfactant. Preferably, the non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol.

The surfactant system of the composition of the present invention may comprise a further co-surfactant system, wherein the co-surfactant system when present is preferably from about 0.5% to about 15%, preferably from about 1% to about 12%, more preferably from about 2% to about 10%, by weight of the surfactant system. One suitable example of a further co-surfactant system is a cationic surfactant.

Amphiphilic Polymer

The composition of the present invention may further comprise from about 0.01% to about 5%, preferably from about 0.05% to about 2%, more preferably from about 0.07% to about 1% by weight of the total composition of an amphiphilic polymer selected from the groups consisting of amphiphilic alkoxylated polyalkyleneimine, amphiphilic graft polymer and mixtures thereof, preferably an amphiphilic polyalkyleneimine Preferably, the amphiphilic alkoxylated polyalkyleneimine is an alkoxylated polyethyleneimine polymer comprising a polyethyleneimine backbone having average molecular weight range from 100 to 5,000, preferably from 400 to 2,000, more preferably from 400 to 1,000

Daltons and the alkoxylated polyethyleneimine polymer further comprising:

(iv) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or mixtures thereof;

(v) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or mixtures thereof; or (vi) a combination thereof; and wherein the alkoxy moieties comprises ethoxy (EO) and/or propxy (PO) and/or butoxy (BO) and wherein when the alkoxylation modification comprises EO it also comprises PO or BO.

Preferred amphiphilic alkoxylated polyethyleneimine polymers comprise EO and PO groups within their alkoxylation chains, the PO groups preferably being in terminal position of the alkoxy chains, and the alkoxylation chains preferably being hydrogen capped. Hydrophilic alkoxylated polyethyleneimine polymers solely comprising ethoxy (EO) units within the alkoxylation chain could also optionally be formulated within the scope of this invention.

For example, but not limited to, below is shown possible modifications to terminal nitrogen atoms in the polyethyleneimine backbone where R represents an ethylene spacer and E represents a C1-C4 alkyl moiety and X— represents a suitable water soluble counterion.

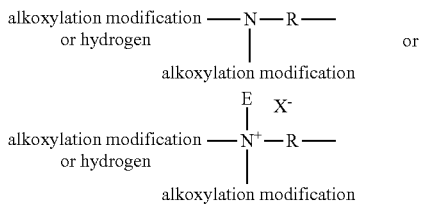

Also, for example, but not limited to, below is shown possible modifications to internal nitrogenatoms in the polyethyleneimine backbone where R represents an ethylene spacer and E represents a $C_1$-$C_4$ alkyl moiety and X— represents a suitable water soluble counterion.

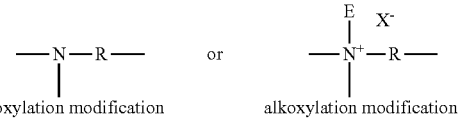

The alkoxylation modification of the polyethyleneimine backbone consists of the replacement of a hydrogen atom by a polyalkoxylene chain having an average of about 1 to about 50 alkoxy moieties, preferably from about 20 to about 45 alkoxy moieties, most preferably from about 30 to about 45 alkoxy moieties. The alkoxy moieties are selected from ethoxy (EO), propoxy (PO), butoxy (BO), and mixtures thereof. Alkoxy moieties solely comprising ethoxy units are outside the scope of the invention though. Preferably, the polyalkoxylene chain is selected from ethoxy/propoxy block moieties. More preferably, the polyalkoxylene chain is ethoxy/propoxy block moieties having an average degree of ethoxylation from about 3 to about 30 and an average degree of propoxylation from about 1 to about 20, more preferably ethoxy/propoxy block moieties having an average degree of ethoxylation from about 20 to about 30 and an average degree of propoxylation from about 10 to about 20.

More preferably the ethoxy/propoxy block moieties have a relative ethoxy to propoxy unit ratio between 3 to 1 and 1 to 1, preferably between 2 to 1 and 1 to 1. Most preferably the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized. Most preferably the degree of quaternization is about 0%.

A preferred polyethyleneimine has the general structure of Formula (II):

has an average of about 10, m of Formula (II) has an average of about 7 and R of Formula (II) is selected from hydrogen, a C1-C4 alkyl and mixtures thereof, preferably hydrogen. The degree of permanent quaternization of Formula (II) may be from 0% to about 22% of the polyethyleneimine backbone nitrogen atoms. The molecular weight of this polyethyleneimine preferably is between 10,000 and 15,000.

An alternative polyethyleneimine has the general structure of Formula (II) but wherein the polyethyleneimine backbone has a weight average molecular weight of about 600, n of formula (I) has an average of about 24, m of Formula (II) has an average of about 16 and R of formula (I) is selected from hydrogen, a $C_1$-$C_4$ alkyl and mixtures thereof, preferably hydrogen. The degree of permanent quaternization of Formula (II) may be from 0% to about 22% of the polyethyleneimine backbone nitrogen atoms. The molecular weight of this polyethyleneimine preferably is between 25,000 and 30,000.

Most preferred polyethyleneimine has the general structure of Formula (II) wherein the polyethyleneimine backbone has a weight average molecular weight of about 600, n of Formula (II) has an average of about 24, m of Formula (II)) has an average of about 16 and R of Formula (II) is hydrogen. The degree of permanent quaternization of Formula (II) is 0% of the polyethyleneimine backbone nitrogen atoms. The molecular weight of this polyethyleneimine preferably is about from about 25,000 to 30,000, most preferably about 28,000.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, as described in more detail in PCT Publication No. WO 2007/135645.

Preferably, the amphiphilic graft polymer herein is a random graft copolymer having a hydrophilic backbone and hydrophobic side chains. Typically, the hydrophilic backbone is less than about 70%, less than about 50%, or from about 50% to about 2%, or from about 45% to about 5%, or from about 40% to about 10% by weight of the polymer. The (II)

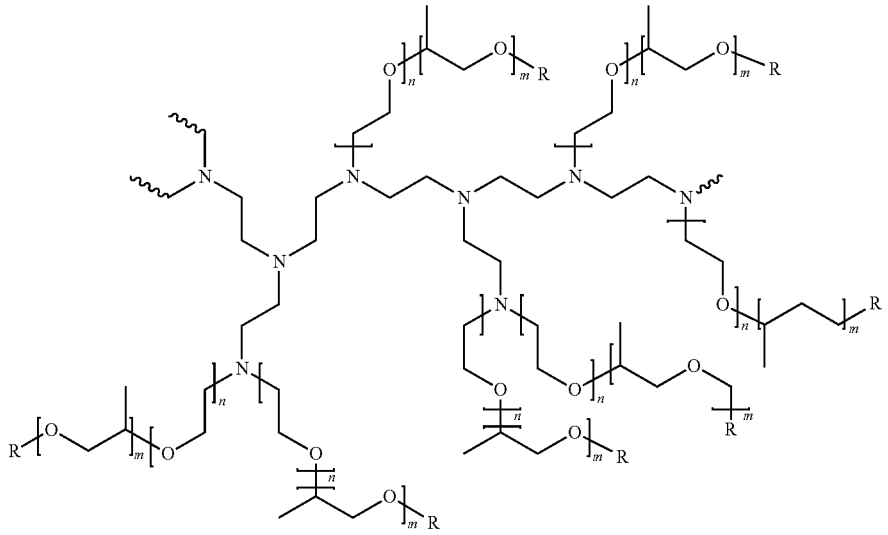

wherein the polyethyleneimine backbone has a weight average molecular weight of about 600, n of Formula (II)

backbone preferably contains monomers selected from the group consisting of unsaturated C3-6 acid, ether, alcohol, aldehyde, ketone or ester, sugar unit, alkoxy unit, maleic anhydride and saturated polyalcohol such as glycerol, and a mixture thereof. The hydrophilic backbone may contain acrylic acid, methacrylic acid, maleic acid, vinyl acetic acid, glucoside, alkylene oxide, glycerol, or a mixture thereof. The polymer may contain either a linear or branched polyalkylene oxide backbone with ethylene oxide, propylene oxide and/or butylene oxide. The polyalkylene oxide backbone may contain more than about 80%, or from about 80% to about 100%, or from about 90% to about 100% or from about 95% to about 100% by weight ethylene oxide. The weight average molecular weight (Mw) of the polyalkylene oxide backbone is typically from about 400 g/mol to 40,000 g/mol, or from about 1,000 g/mol to about 18,000 g/mol, or from about 3,000 g/mol to about 13,500 g/mol, or from about 4,000 g/mol to about 9,000 g/mol. The polyalkylene backbone may be extended by condensation with suitable connecting molecules, such as dicarboxylic acids and/or diisocianates.

The backbone contains a plurality of hydrophobic side chains attached thereto, such as a C4-25 alkyl group; polypropylene; polybutylene; a vinyl ester of a saturated monocarboxylic C1-6 acid; and/or a C1-6 alkyl ester of acrylic or methacrylic acid. The hydrophobic side chains may contain, by weight of the hydrophobic side chains, at least about 50% vinyl acetate, or from about 50% to about 100% vinyl acetate, or from about 70% to about 100% vinyl acetate, or from about 90% to about 100% vinyl acetate. The hydrophobic side chains may contain, by weight of the hydrophobic side chains, from about 70% to about 99.9% vinyl acetate, or from about 90% to about 99% vinyl acetate. The hydrophobic side chains may also contain, by weight of the hydrophobic side chains, from about 0.1% to about 10% butyl acrylate, or from about 1% to about 7% butyl acrylate, or from about 2% to about 5% butyl acrylate. The hydrophobic side chains may also contain a modifying monomer, such as styrene, N-vinylpyrrolidone, acrylic acid, methacrylic acid, maleic acid, acrylamide, vinyl acetic acid and/or vinyl formamide, especially styrene and/or N-vinylpyrrolidone, at levels of from about 0.1% to about 10%, or from about 0.1% to about 5%, or from about 0.5% to about 6%, or from about 0.5% to about 4%, or from about 1% to about 3%, by weight of the hydrophobic side chains.

Preferred graft polymers for the present invention are amphiphilic graft polymers based on water-soluble polyalkylene oxides (A) as a graft base and side chains formed by polymerization of a vinyl ester component (B), said polymers having an average of three, preferably one graft site per 50 alkylene oxide units and mean molar masses Mw of from 3000 to 100 000.

A material within this definition, based on polyethylene oxide of molecular weight 6000 (equivalent to 136 ethylene oxide units), containing approximately 3 parts by weight of vinyl acetate units per 1 part by weight of polyethylene oxide, and having itself a molecular weight of 24 000, is commercially available from BASF as Sokalan® HP22.

The composition of the present invention may further comprise at least one active selected from the group consisting of: i) a salt, ii) a hydrotrope, iii) an organic solvent, and mixtures thereof.

Salt

The composition of the present invention may further comprise from about 0.05% to about 2%, preferably from about 0.2% to about 1.5%, or more preferably from about 0.5% to about 1%, by weight of the total composition of a salt, preferably a monovalent, divalent inorganic salt or a mixture thereof, more preferably sodium chloride, sodium sulphate or a mixture thereof, most preferably sodium chloride.

Hydrotrope

The composition of the present invention may further comprise from about 0.1% to about 10%, or preferably from about 0.5% to about 10%, or more preferably from about 1% to about 6%, by weight of the total composition of a hydrotrope or a mixture thereof, preferably sodium cumene sulfonate.

Organic Solvent

The composition of the present invention may further comprise an organic solvent. Suitable organic solvents include C4-14 ethers and diethers, polyols, glycols, alkoxylated glycols, C6-C16 glycol ethers, alkoxylated aromatic alcohols, aromatic alcohols, aliphatic linear or branched alcohols, alkoxylated aliphatic linear or branched alcohols, alkoxylated C1-C5 alcohols, C8-C14 alkyl and cycloalkyl hydrocarbons and halohydrocarbons, and mixtures thereof. Preferably the organic solvents include alcohols, glycols, and glycol ethers, alternatively alcohols and glycols. The composition comprises from 0% to less than about 50%, preferably from about 0.01% to about 25%, more preferably from about 0.1% to about 10%, or most preferably from about 0.5% to about 5%, by weight of the total composition of an organic solvent, preferably an alcohol, more preferably ethanol, a polyalkyleneglycol more preferably polypropyleneglycol, and mixtures thereof.

Adjunct Ingredients

The cleaning composition herein may optionally comprise a number of other adjunct ingredients such as builders (e.g., preferably citrate), chelants, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

The elements of the composition of the invention described in connexion with the first aspect of the invention apply mutatis mutandis to the other aspects of the invention.

Method of Washing

In another aspect, the invention is directed to a method of manually washing dishware with the composition of the present invention. The method comprises the steps of delivering a composition of the present invention onto the soiled dishware. The composition can be pre-dissolved in a sink of water to create an aqueous washing solution and the soiled dishware is immersed in the aqueous washing solution. The dishware can be subsequently rinsed. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually about 1 to about 20 L.

The composition herein can be applied in its diluted form. Soiled dishware are contacted with an effective amount, typically from about 0.5 mL to about 20 mL (per about 25 dishes being treated), preferably from about 3 mL to about 10 mL, of the cleaning composition, preferably in liquid form, of the present invention diluted in water. The actual amount of cleaning composition used will be based on the judgment of the user, and will typically depend upon factors such as the particular product formulation of the cleaning composition, including the concentration of active ingredients in the cleaning composition, the number of soiled dishes to be cleaned, the degree of soiling on the dishes, and the like. Generally, from about 0.01 mL to about 150 mL, preferably from about 3 mL to about 40 mL of a cleaning composition of the invention is combined with from about 2,000 mL to about 20,000 mL, more typically from about 5,000 mL to about 15,000 mL of water in a sink having a volumetric capacity in the range of from about 1,000 mL to about 20,000 mL, more typically from about 5,000 mL to about 15,000 mL. The soiled dishware are immersed in the sink containing the diluted cleaning compositions then obtained, where contacting the soiled surface of the dishware with a cloth, sponge, or similar cleaning implement cleans them. The cloth, sponge, or similar cleaning implement may be immersed in the cleaning composition and water mixture prior to being contacted with the dishware, and is typically contacted with the dishware for a period of time ranged from about 1 to about 10 seconds, although the actual time will vary with each application and user. The contacting of cloth, sponge, or similar cleaning implement to the dishware is preferably accompanied by a concurrent scrubbing of the dishware.

Alternatively, the neat dishwashing detergent product can also be applied directly on the dishware, or more preferably directly on an optionally but preferably pre-wetted cleaning implement, preferably a pre-wetted sponge. Typically between 0.1 mL and 25 mL, rather between 1 mL and 10 mL of the dishwashing detergent product is dosed by the consumer on the sponge. This pre-wetted detergent carrying sponge is consequently contacted with optionally pre-wetted dishware to be cleaned. The cleaning action can be performed under a tap of running water such that applied detergent and removed soil can be rinsed off the dishware. Alternatively, the cleaning action can be done without running water, followed by a consequent rinsing step to remove the applied detergent and soil from the dishware. Within this method of the present invention the dissolution of the composition with water in this cleaning implement, preferably a sponge, will be delayed such that the cleaning product is solely gradually released, characterized by the composition having a decrease in viscosity of less than 85%, preferably less than 80%, more preferably less than 75%, most preferably between 65% and 75%, based on the initial viscosity of the composition at 60% product concentration in demineralized water at 20° C.

Another aspect of the present invention is directed to use of a hand dishwashing cleaning composition of the present invention for providing good sudsing profile. Preferably, the use is applicable under full sink washing condition and direct application of product on cleaning implement and washing under tap.

Test Methods

The following assays set forth must be used in order that the invention described and claimed herein may be more fully understood.

Test Method 1: Viscosity

The rheology profile is measured using a "Brookfield DV-II+ Pro" viscometer. The neat viscosity is measured at 20° C., spindle 31 and RPM: 12. The viscosity at 60% product concentration in demineralized water is measured at 20° C., spindle 31 and RPM: 12.

Test Method 2: In-Sink Dissolution Profile Test

This method allows for the determination of the dissolution profile of the respective detergents under in-sink condition over time using conductivity monitoring under fixed test conditions. The steps to the method are as follows:

1. 4000 mL of demineralized water at 20° C. (=/−0.5° C.) is added to a 5000 mL glass beaker (diameter~18 cm, height~25.5 cm) and mixed with an overhead mixer (ex IKA Labortechnik—ikaa2684700 reference ex Merck catalogue 2002) using a 4 blades mixer (ex IKA Labortechnik: diameter=10 cm, blades inclination=45°) with set agitation when actioned at 90 RPM (±1). The mixer is set at a 5 cm depth in the middle of the stirring solution. The conductivity probe (TetraCon 325 ex WTW) is set at 4 cm depth in the washing solution at 1 cm from the side wall of the glass beaker.
2. 5 mL of detergent according to the invention or of the comparative detergent is added gently at the bottom in the center of the beaker. The overhead stirrer and conductivity measurements are started straight after the detergent has been added.
3. The conductivity is measured every 5 seconds and the experiment stops when the conductivity measurement has remained constant for at least 20 seconds. The dissolution time recorded is the number of seconds at which 30%, 70% and 90% of the final conductivity value has been achieved.
4. The experiment is repeated three times and the average value is reported.

Test Method 3: Foamability Test

The objective of the foamability test is to define the foam building potential of a detergent composition applied on a sponge.

1. For each test product, 30 g of aqueous wash solution (15 dH water hardness, 20° C.) of the targeted product concentrations (20%, 50%) are prepared.
2. Synthetic dishwashing sponges (Brand: Delhaize Belgium scour sponges with grip—dimensions: length 9.5 cm, width 6.5 cm and height 4.5 cm, item number 17152/0000) are pre-conditioned by washing them without detergent during 3 cycles of 32 min at 40° C. and 15 dH water hardness in a laundry washing machine (Brand: Miele Softtronic W3205—Express cycle), and leaving them to dry for 2 days under a fume food (Brand: Kötermann type 2-453-GAHB) with air flow 0.64 m/sec under standard lab conditions (20-22° C., 40-60% rH).
3. The respective 30 g wash solution is distributed homogeneously over the soft side opposite to the scouring side of the dry sponge, allowing the wash solution to completely submerge into the sponge during 20 seconds.
4. While wearing latex lab gloves and while holding the scouring side down, the sponge is consequently manually squeezed for 10 times with maximum power (frequency 60 squeezes per minute) after which the generated foam on the sponge is collected with a spatula in a cup allowing accurate volumetric grading.
5. 3 replicates are run for each product concentration and collected foam volumes are averaged. For each product concentration and replicate a new dry sponge is used and all tests are run by the same expert operator.

EXAMPLES

The following examples are provided to further illustrate the present invention and are not to be construed as limitations of the present invention, as many variations of the present invention are possible without departing from its spirit or scope.

Example 1: Cleaning Composition Comprising Alkyl Polyglucoside Surfactant and Comparative Compositions The speed of product dissolution in a sponge and under dilution in a sink has been assessed for a cleaning composition comprising alkyl polyglucoside surfactant according to the invention (Inventive Composition 1). In parallel, comparative composition is prepared by replacing the alkyl polyglucoside surfactant with more solvent to achieve the same viscosity target (Comparative Composition 1) for a comparative assessment. The foregoing compositions are produced through standard mixing of the components described in Table 1.

TABLE 1

| Inventive and Comparative Compositions | | |
|---|---|---|
| Ingredients (wt % as 100% active) | Inventive Composition 1 | Comparative Example 1 |
| Surfactant | | |
| C1213AE0.6S (33.44% branching) | 23.03% | 23.6% |
| C1214 alkyl dimethyl amine oxide | 6.22% | 6.4% |
| Alkylpolyglucoside (APG: Glucopon 600) | 0.75% | — |
| Solvent | | |
| Ethanol | 2.4% | 2.2% |
| Polypropyleneglycol (MW2000) | 1% | 1% |
| Sodium cumene sulphonate | — | 1.5% |
| Performance Additives | | |
| Baxxodur ® ECX210* | 0.53 | 0.55 |
| Alkoxylated polyethyleneimine (PEI600EO24PO16) | 0.5 | 0.5 |
| Electrolyte | | |
| NaCl | 0.8% | 0.8% |
| Balance | | |
| Water and minors (dye, perfume, preservative) | To 100% | To 100% |
| Physical Properties | | |
| Viscosity (neat) | 1032 cps | 995 cps |
| Viscosity (60% product concentration) | 323 cps | 126 cps |
| pH | 8.94 | 8.94 |

*Baxxodur ® ECX210: mixture of 4-methylcyclohexane-1,3-diamine and 2-methylcyclohexane-1,3-diamine, available from BASF.

Example 1a: Foamability and Dissolution Profile

Results for the foamability and dissolution tests are summarized in Table 2. The results clearly show that with Inventive Composition 1 the product release from the sponge is clearly retarded upon alkyl polyglucoside insertion versus the Comparative Composition 1. However, the dissolution kinetics when dissolving the finished product in the sink is not compromised. Indeed, while the two products have about equal foam volume creation potential in the sponge (20% foamability data), product is more gradually released from the Inventive Composition 1, as evidence by a lower initial foam volume (50% foamability data) versus the Comparative Composition. This delayed release/dissolution of product in a sponge, does not come at the expense of product dissolution under sink type conditions, as evidenced by a substantial similar dissolution time for the Inventive Composition 1 vs. the Comparative Composition 1.

TABLE 2

| Foamability and Dissolution Results | | |
|---|---|---|
| | Inventive Composition 1 | Comparative Example 1 |
| Product Release from Sponge | | |
| 50% Foamability | 133 mL | 207 mL |
| 20% Foamability | 360 mL | 370 mL |
| Product Dissolution in Sink | | |
| Time to 30%/70%/90% Dilution | 71 sec/153 sec/264 sec | 65 sec/147 sec/301 sec |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand dishwashing cleaning composition comprising:

a) from about 5% to about 30% by weight of the total composition of a surfactant system comprising:
   (i) from about 70% to about 80%, by weight of the surfactant system of an alkyl ethoxy sulfate;
   (ii) from about 18% to about 26%, by weight of the surfactant system of an amine oxide surfactant; and
   (iii) from 1% to 5% by weight of the surfactant system of an alkyl polyglucoside surfactant; and b) from about 50% to about 85% by weight of the total composition of water.

2. The composition according to claim 1, wherein the alkyl ethoxy sulfate is an alkyl ethoxy sulfate with an average degree of ethoxylation of less than about 5, and an average level of branching of from about 5% to about 60%.

3. The composition according to claim 2, wherein the alkyl ethoxy sulfate has an average degree of ethoxylation of less than about 2 and more than about 0.5 and an average level of branching from about 25% to about 45%.

4. The composition according to claim 1, wherein the amine oxide surfactant is selected from the group consisting of linear or branched alkyl amine oxide, linear or branched alkyl amidopropyl amine oxide, and mixtures thereof.

5. The composition according to claim 3, wherein the amine oxide surfactant is linear alkyl dimethyl amine oxide selected from the group consisting of linear C10 alkyl dimethyl amine oxide, linear C12-C14 alkyl dimethyl amine oxides and mixtures thereof.

6. The composition according to claim 1, wherein the alkyl polyglucoside surfactant is a C12-C14 alkyl polyglucoside surfactant with an average degree of polymerization of between about 1.2 and about 1.6.

7. The composition according to claim 1, further comprising from about 1% to about 25% by weight of the surfactant system of a non-ionic surfactant, and wherein the non-ionic surfactant is an alkyl ethoxylated non-ionic surfactant comprising on average 9 to 15 carbon atoms in its alkyl chain and on average from 5 to 12 units of ethylene oxide per mole of alcohol.

8. The composition according to claim 1, wherein the non-ionic surfactant is an alkyl ethoxylated non-ionic surfactant comprising on average 10 to 14 carbon atoms in its alkyl chain and on average from 7 to 8 units of ethylene oxide per mole of alcohol.

9. The composition according to claim 1, further comprising from about 0.05% to about 2%, by weight of the total composition of an amphiphilic polymer selected from the group consisting of amphiphilic alkoxylated polyalkyleneimine, amphiphilic graft polymer and mixtures thereof.

10. The composition according to claim 9, wherein the amphiphilic alkoxylated polyalkyleneimine is an alkoxylated polyethyleneimine polymer comprising a polyethyleneimine backbone having average molecular weight range from about 100 to about 5,000 Daltons and the alkoxylated polyethyleneimine polymer further comprising:

one or two alkoxylation modifications per nitrogen atom by a polyalkoxylene chain having an average of 1 to 50 alkoxy moieties per modification, wherein the terminal alkoxy moiety of the alkoxylation modification is capped with hydrogen, a C1-C4 alkyl or mixtures thereof, (ii) an addition of one C1-C4 alkyl moiety and one or two alkoxylation modifications per nitrogen atom by a polyalkoxylene chain having an average of 1 to 50 alkoxy moieties per modification wherein the terminal alkoxy moiety is capped with hydrogen, a C1-C4 alkyl or mixtures thereof, or (iii) a combination thereof; and wherein the alkoxy moieties comprises ethoxy (EO) and/or propoxy (PO) and/or butoxy (BO) and wherein when the alkoxylation modification comprises EO it also comprises PO or BO.

11. The composition according to claim 1 further comprising at least one active selected from the group consisting of: i) from about 0.05% to about 2% by weight of the total composition of a salt; ii) from about 1% to about 10% by weight of the total composition of a hydrotrope; iii) from about 0.01% to about 25% by weight of the total composition of an organic solvent; and iv) mixtures thereof.

12. The composition according to claim 1, wherein the composition further comprises a builder.

13. The composition according to claim 1, wherein the composition has a pH range of from about 6 to about 14 as measured at about 10% dilution in distilled water at about 20° C.

14. The composition according to claim 1, wherein the composition has an initial viscosity of from about 10 mPa·s to about 10,000 mPa·s as measured on a Brookfield DV-II+ Pro Viscometer using spindle 31 at about 12 RPM at about 20° C.

15. The composition according to claim 1, wherein the composition displays delayed dissolution with water in a cleaning implement, characterized by the composition having a decrease in viscosity of less than about 85% based on an initial viscosity of the composition, at a about 60% product concentration in demineralized water at about 20° C.

16. The composition according to claim 1, wherein the composition exhibits a dissolution time of less than about 160 seconds.

17. A method of manually washing dishware comprising the steps of:

a) delivering a composition according to claim 1 onto soiled dishware or a cleaning implement;
b) cleaning the dishware with the composition in the presence of water; and
c) optionally, rinsing the dishware.

18. A method of manually washing dishware comprising the steps of delivering a composition according to claim 1 into a volume of water to form a wash solution and immersing the dishware in the solution.

19. The composition according to claim 1, wherein the alkyl polyglucoside comprises greater than 0.5% and up to 1.5% by weight of the total composition of the handwashing cleaning composition, and wherein at least 50% by weight of the alkyl polyglucoside comprises an average degree of polymerization of between 0.1 and 3 and an average alkyl carbon chain length between 10 and 16.

20. The composition according to claim 1, further comprising: greater than 3% but less than about 10% by weight of the total composition of the hand dishwashing cleaning composition of an organic solvent.

* * * * *